United States Patent [19]

Hutchins

[11] Patent Number: 4,986,036

[45] Date of Patent: Jan. 22, 1991

[54] ABRADING OR POLISHING TOOL

[75] Inventor: Donald H. Hutchins, Sierra Madre, Calif.

[73] Assignee: Hutchins Manufacturing Company, Pasadena, Calif.

[21] Appl. No.: 488,226

[22] Filed: Mar. 3, 1990

[51] Int. Cl.[5] ..... B24B 23/00

[52] U.S. Cl. ..... 51/170 R; 418/178

[58] Field of Search ..... 51/170 R, 170 T, 170 MT, 51/170 TL, 177; 418/178, 179; 15/49 R, 97 R, 97 B, 98

[56] References Cited

U.S. PATENT DOCUMENTS

| | | | |
|---|---|---|---|
| 3,552,985 | 1/1971 | Bayley | 418/178 |
| 4,592,170 | 1/1986 | Hutchins et al. . | |
| 4,804,317 | 2/1989 | Smart et al. | 418/178 |

*Primary Examiner*—Roscoe V. Parker

*Attorney, Agent, or Firm*—William P. Green

[57] ABSTRACT

A portable abrading or polishing tool including a body structure containing an air motor which drives a head carrying an abrading or polishing element to abrade or polish a work surface. The motor has a housing containing a chamber within which a rotor turns, with an essentially vertical shaft of the motor projecting downwardly through a bottom wall of the housing and operatively connected to the head to drive it. A wear plate is located vertically between the rotor and the bottom wall of the housing and is formed of a material harder than the rotor or housing, and contains an opening through which the shaft projects downwardly in closely fitting but non-contacting relation to minimize downward escape of air from the chamber along the shaft and protect a bearing carried by the bottom wall of the housing against loss of lubricant by the pressure of escaping air.

9 Claims, 4 Drawing Sheets

FIG. 1
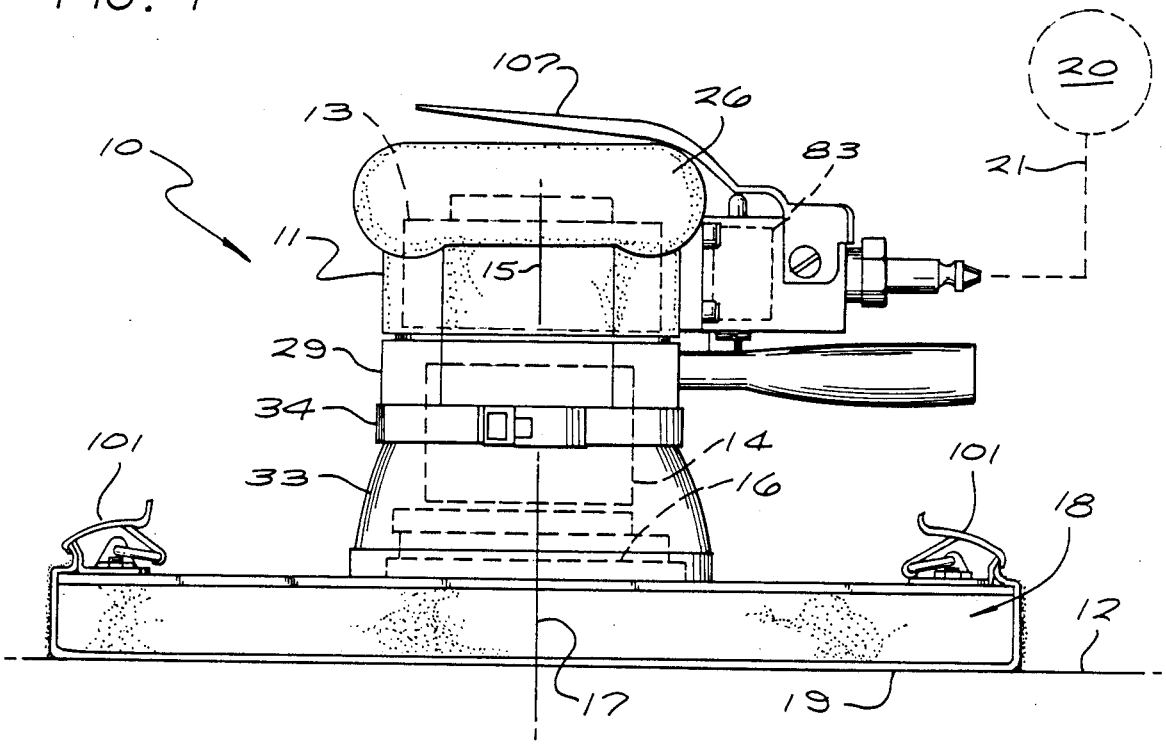
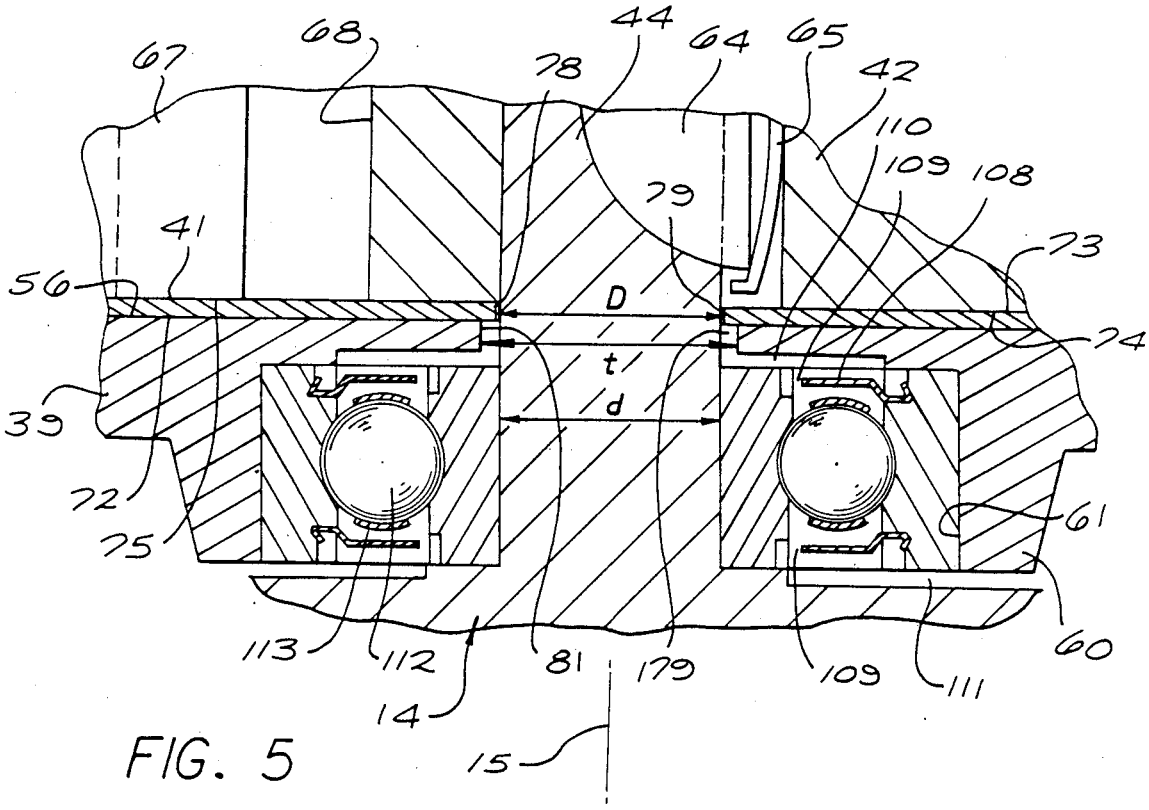
FIG. 5

ABRADING OR POLISHING TOOL

This invention relates to improved air driven abrading or polishing tools.

BACKGROUND OF THE INVENTION

The tools of the invention are of a type including a body structure which is adapted to be held and be manipulated by a user, and which carries an air motor driving a head to which a sheet of sandpaper or other abrading or polishing element is connectable. The motor has a housing containing a chamber defined by top and bottom walls and a side wall, with a rotor being located in the chamber and connected to a shaft journaled for rotation about an essentially vertical axis by upper and lower bearings carried by the top and bottom walls respectively. The shaft is operatively connected beneath the lower bearing to the polishing or abrading head.

In prior devices of this type, the contact of the undersurface of the rotor with the bottom wall of the housing has tended to produce wear on both of these surfaces ultimately causing excessive leakage of air between those surfaces decreasing the efficiency and maximum speed of operation of the tool. Also, air has tended to leak downwardly from the motor chamber though the lower bearing carried by the bottom wall of the housing, with further decrease in operating efficiency and adverse effect on the bearing. This air leaking downwardly may carry contaminants into the bearing and may force grease or other lubricant from the bearing, both of which effects can reduce the overall effective life of the bearing and motor.

SUMMARY OF THE INVENTION

A major purpose of the present invention is to provide improvements in an air driven abrading or sanding tool of the above discussed type, for reducing wear of the rotor and the bottom wall of the housing, and for minimizing leakage of air downwardly from the rotor chamber past the bottom bearing. These results are attained by provision of a generally horizontally extending plate in the motor chamber at a location beneath the rotor and above the bottom wall of the motor housing. This plate is formed of a material harder than the rotor and harder than the bottom wall of the housing, and is rotatably contacted by and supports the rotor in a manner protecting it against wear. The plate contains a circular opening through which a cylindrical portion of the motor shaft projects downwardly toward the lower bearing. The opening in the plate is slightly greater in diameter than the external diameter of the cylindrical portion of the shaft which is received within the opening, to prevent damage to either of these parts by frictional engagement as the shaft turns. However, the diameter of the opening exceeds that of the contained portion of the shaft only very slightly, and specifically by an amount not more than about six ten thousandths of an inch, to assure minimization of the amount of air flow downwardly along the shaft and toward the bottom bearing. Preferably, the plate is formed of spring steel.

BRIEF DESCRIPTION OF THE DRAWINGS

The above and other features and objects of the invention will be better understood from the following detailed description of the typical embodiment illustrated in the accompanying drawings, in which:

FIG. 1 is a side elevational view of a sander embodying the invention;

FIG. 5 is an enlarged detail view corresponding to a portion of FIG. 2 taken within the area identified by the number 5 in FIG. 2; and FIG. 6 is an exploded perspective view of the various elements of the air motor of the sander.

DESCRIPTION OF THE PREFERRED EMBODIMENT

Figure 2:
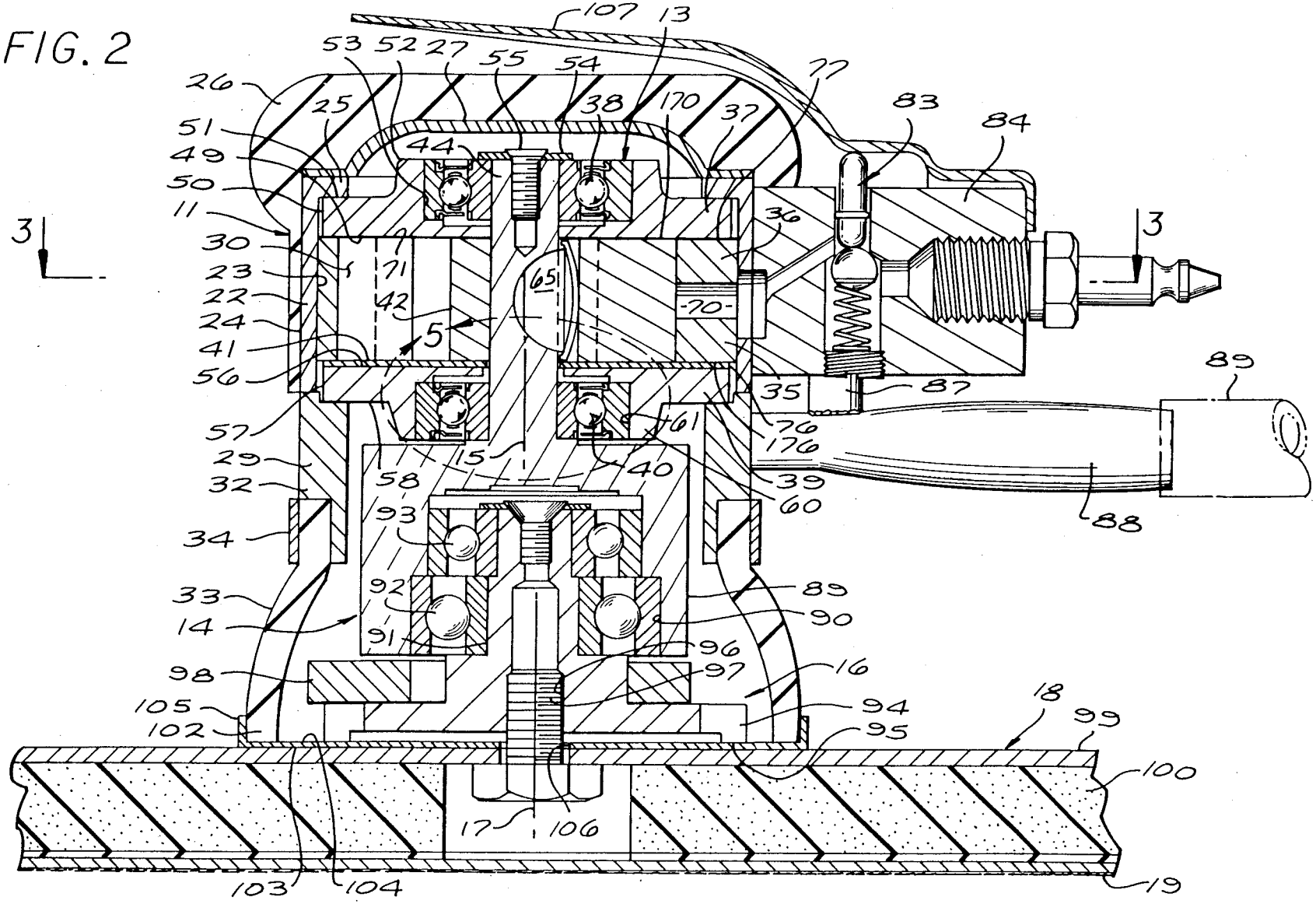
FIG. 2 is an enlarged central vertical section through the sander of FIG. 1.

The drawings typically illustrate the invention as applied to a power driven orbital sander, though it will be apparent that the novel aspects of the air motor arrangement of the invention may also be utilized in other types of portable power driven abrading or polishing tools. The orbital tool 10 shown in the drawings has a body structure 11 shaped externally as a handle to be grasped by a user for holding the tool and moving it along a typically horizontal work surface 12 to sand or polish that surface. An air driven motor 13 contained within body structure 11 drives a carrier part 14 rotatively about a vertical axis 15, with a part 16 being connected to carrier 14 for rotation relative thereto about a second vertical axis 17, in a relation driving an abrading head or shoe 18 and a carried sheet of sandpaper 19 orbitally about axis 15 to sand surface 12. Air is supplied to motor 13 from a source 20 of compressed air through a line 21 connecting into the rear of body structure 11.

Figure 4:
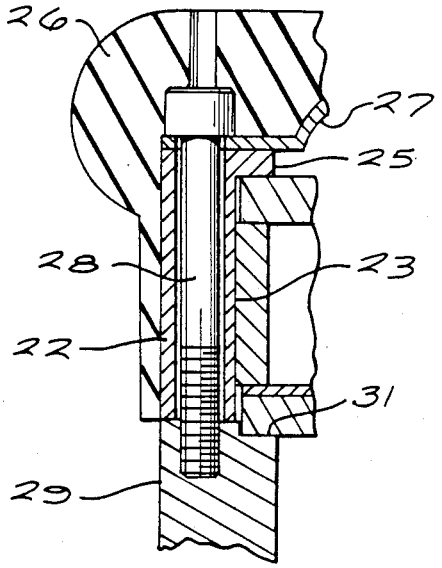
FIG. 4 is a fragmentary vertical section taken on line 4—4 of FIG. 3.
Figure 4:
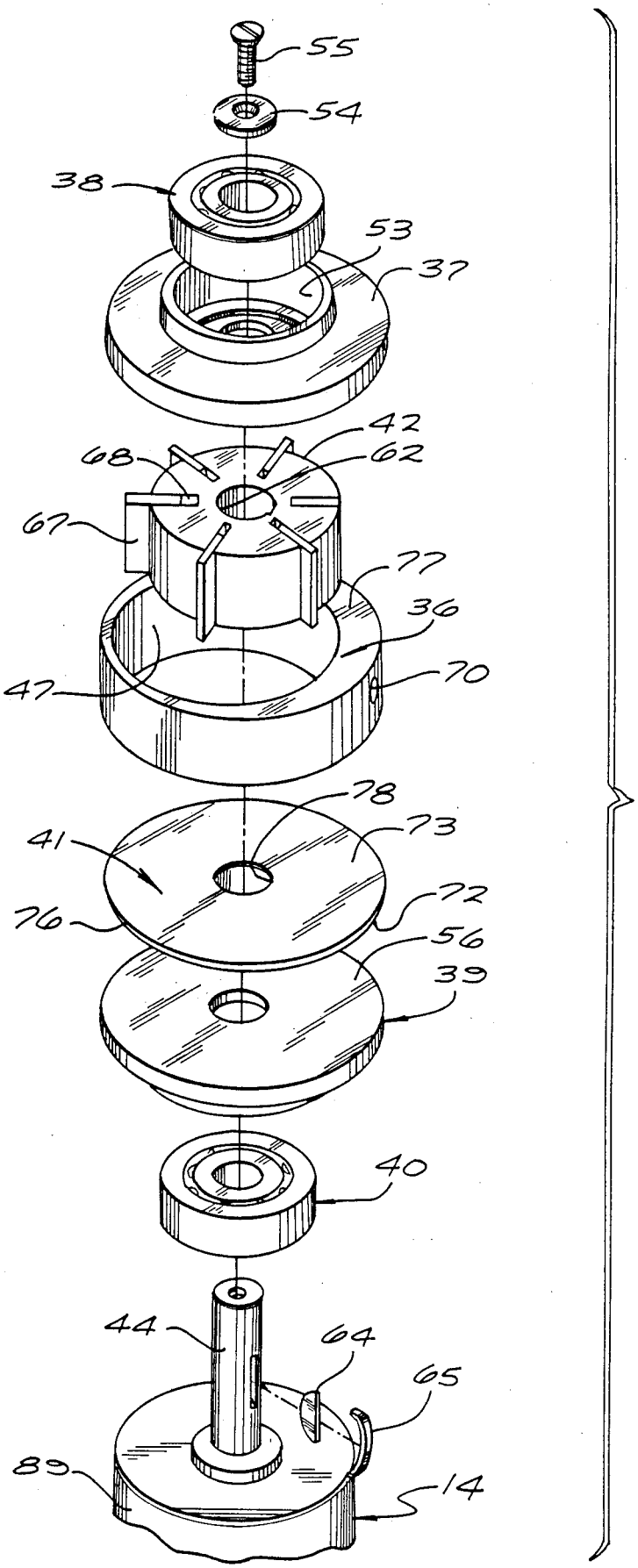

The body structure 11 may be formed as an assembly of parts including a rigid metal main body part 22 having an internal surface 23 defining a recess within which motor 13 is received. Part 22 may have an outer surface 24 of square horizontal section, and have an annular horizontal flange 25 at its upper end for confining the motor against upward removal from the body. A square cushioning element 26 may be carried about body part 22 and extend across its upper side, and may be formed of an appropriate rubber, to function as a cushioned handle element by which the device is held in use. A rigid reinforcing element 27 is bonded to the undersurface of the top horizontal portion of handle cushion 26, and with the attached part 26 is secured to body 22 by four screws 28 (see FIG. 4) extending downwardly through vertically aligned openings or passages in parts 22 and 27, with the heads of the screws engaging downwardly against part 27, and with the lower ends of the screws being connected threadedly to a retainer 29 which is tightenable upwardly against the motor to retain it in recess 30 formed within the body structure. The radially inner portion of retainer 29 forms an upwardly facing annular horizontal shoulder surface 31 (see FIG. 4) which projects radially inwardly beyond surface 23 to block downward withdrawal of the motor. The lower portion of retainer 29 forms a tubular circular skirt 32 to which the upper end of a tubular rubber boot 33 is secured by an annular clamp 34.

The air motor 13 has a sectionally formed stator or housing 35 (see FIG. 2) including a vertically extending side wall 36, a top wall 37 carrying a bearing 38 and a bottom wall 39 carrying a second bearing 40. A horizontal circular plate 41 with which the present invention is particularly concerned is located above bottom wall 39. The rotor 42 of the motor is contained and driven rotatively within the motor chamber 43 formed by the housing parts, and is connected to an upper shaft portion 44 of carrier 14, to drive that carrier rotatively about axis 15.

Side wall 36 of the motor housing has an external cylindrical surface 46 which fits closely within and engages internal cylindrical surface 23 of body 22 to be located thereby. Internally, side wall 36 has a vertical surface 47 which is cylindrical but eccentric with respect to axis 15 (see FIG. 3), and more particularly may be centered about a vertical axis 48 which is parallel to but offset from axis 15 to give the desired eccentricity to surface 47.

Top wall 37 has a planar horizontal undersurface 49 forming the top of chamber 43 within which rotor 42 is received. Top wall 37 has an outer edge surface 50 which is received closely adjacent internal surface 23 of part 22. At its upper side, top wall 37 has an annular surface 51 which is engaged by annular flange 25 of body part 22 to clamp top wall 37 downwardly against side wall 36 of the motor. Radially inwardly of surface 51, top wall 37 has an annular portion 52 defining a cylindrical recess 53 within which the outer race of ball bearing 38 is received and located. The externally cylindrical vertical shaft portion 44 of carrier 14 is a close fit within the inner race of bearing 38, and is retained against downward withdrawal from bearing 38 by a washer 54 secured to shaft 44 by a screw 55 connected into the upper end of the shaft. The washer projects radially outwardly far enough to engage the upper surface of the inner race of the bearing 38 to maintain the parts in assembled condition.

The bottom wall 39 of the motor housing or stator is similar to top wall 37, but inverted with respect to the top wall. More particularly, bottom wall 39 has an upper planar horizontal surface 56, a cylindrical outer edge surface 57 which fits fairly closely within cylindrical surface 23 of body part 22, and a horizontal annular undersurface 58 which is engaged annularly by shoulder surface 31 of retainer 29 to clamp bottom wall 39 upwardly against side wall 36 of the motor housing. Radially inwardly of surface 58, bottom wall 39 has a downwardly projecting annular portion 60 defining an essentially cylindrical recess 61 within which bottom ball bearing assembly 40 is received and located. The inner race of bearing 40 is a close fit about the externally cylindrical shaft portion 44 of carrier 14, to coact with upper bearing 38 in mounting part 14 for its desired rotation about axis 15.

Rotor 42 of the motor has an inner cylindrical passage 62 which fits closely about the external cylindrical surface 63 of shaft portion 44 of part 14. A key 64 received within opposed axially extending grooves in parts 44 and 42 transmits rotary motion from rotor 42 to shaft 44. A leaf spring 65 interposed radially between the rotor and key may exert radial force in opposite directions against these parts to take up any slight looseness which may occur.

Figure 3:
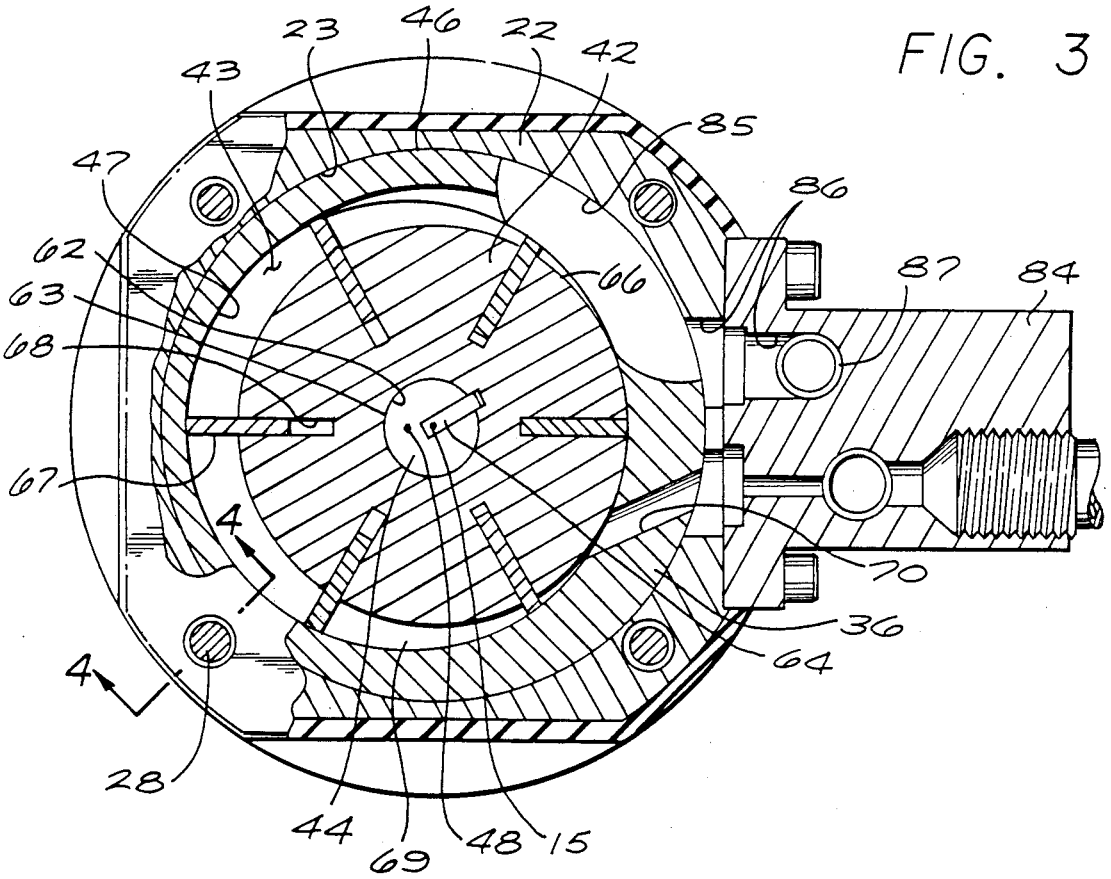
FIG. 3 is a horizontal section taken primarily on line 3—3 of FIG. 2.

Externally, rotor 42 has a vertical cylindrical surface 66 centered about axis 15 and therefore eccentric with respect to motor housing surface 47 as seen in FIG. 3. A series of vanes 67 received slidably within radial slots 68 in the rotor are engageable with surface 47 of the motor housing, to form a series of air compartments 69 circularly between the vanes, which compartments vary progressively in size as the rotor turns so that the introduction of air into these compartments through an inlet passage 70 in side wall 36 of the motor causes rotation of the rotor in a clockwise direction as viewed in FIG. 3.

At its upper side, rotor 42 has a planar horizontal top surface 170 which engages the horizontal undersurface 49 of top wall 37. The upper surfaces 71 of vanes 67 are also horizontal and engage surface 49 in sealing relation.

Plate 41 at the underside of the rotor is flat, having a bottom horizontal surface 72 which engages the upper horizontal surface 56 of bottom wall 39. At its upper side, plate 41 has a horizontal surface 73 which is engaged by a horizontal planar undersurface 74 of rotor 42, and by horizontal bottom edges 75 of vanes 67. The outer circular edge 76 of plate 41 is of a diameter to fit fairly closely within inner cylindrical surface 23 of part 22, with the outer edge portion of plate 41 being confined and clamped vertically between the bottom horizontal planar surface 176 of side wall 36 and the upper surface 56 of bottom wall 39, as seen in FIG. 2. The upper planar horizontal surface 77 of side wall 36 is engageable with the horizontal undersurface 49 of top wall 37 in the assembled condition of the parts.

The plate 41 at the underside of the rotor is formed of a material which is harder than the material of the rotor 42 and its vanes 67, and harder than the material of bottom wall 39 of the motor housing, as well as its other two walls 36 and 37. The hard material of disc 41 effectively resists wear as the rotor turns, and also protects the rotor surface 74 and the bottom edges of the vanes against wear. Preferably, disc 41 is formed of spring steel, having a Rockwell hardness of at least about 45 on the C scale. In the presently preferred arrangement, the Rockwell hardness of the spring steel plate 41 is 49 on the C scale. The parts 36, 37, 39, 42 and 67, on the other hand, may be molded from fused powdered metal, giving these parts a Rockwell hardness in a much lower range. For example, the Rockwell hardness of these parts may be not greater than about 20 on the C scale. A presently preferred material for the rotor is the powdered metal composition identified by the Metal Powder Industries Federation as composition FC 0505 - 30, which is five percent copper and ninety five percent iron. The Rockwell hardness of this material is between 2 and 12 on the C scale. The presently preferred material for the motor housing or stator parts 36, 37 and 39 is the material identified by the Metal Powder Industries Federation as composition FX 2008 - 60, which has a Rockwell hardness between about 10 and 20 on the C scale.

At its center, plate 41 contains a circular opening 78 which is centered about axis 15 and which is of a diameter greater than that of external cylindrical surface 63 of the upper shaft portion 44 of part 14, but which exceeds the diameter of that shaft only slightly, to leave a very small annular gap 79 radially between the inner edge 78 of plate 41 and the shaft. The diameter D of opening 78 is not more than six ten thousandths (0.0006) of an inch greater than the diameter d of the external surface 63 of the portion of shaft 44 which is received within opening 78. For best results, the difference between these two diameters is between about one ten thousandth of an inch (0.0001) and six ten thousandths of an inch (0.0006). This very close spacing prevents the downward escape of any substantial flow of air from within the motor chamber toward lower bearing 40, thus maximizing the operating efficiency of the motor and preventing contamination of the bearing. In addition, the closely spaced relationship of plate 41 and shaft 44 prevents the air from forcing grease or other lubricants downwardly from the bearing. At the same time, the inner edge of plate 41 at opening 78 does not contact shaft 44, to thereby avoid frictional damage to the parts which would result if contact were permitted at that location.

In order to maintain the discussed very closely spaced relationship between edge 78 of plate 41 and surface 63 of shaft 44, the tolerances of edge 78 and surface 63 are controlled very precisely during manufacture. In the preferred construction, diameter D of inner edge 78 of plate 41 is maintained between a maximum of 0.3941 inches and a minimum of 0.3938 inches, while the diameter d of shaft surface 63 is kept between a maximum of 0.3937 inches and a minimum of 0.3935 inches. Thus, the difference between diameters D and d is never greater than 0.0006 of an inch, and is never less than 0.0001 of an inch to always assure against wearing contact.

As seen in FIG. 5, bottom wall 39 of the motor housing has an inner circular edge 81 about shaft 44 directly beneath the inner edge 78 of plate 41. The diameter t of opening 81 is greater than the diameter D of opening 78 of plate 41, leaving a gap 179 between opening 81 and the shaft substantially wider than the gap 79 between disc 41 and the shaft. The opening 81 in the bottom plate may thus be formed by less precise methods than is the very precisely dimensioned opening 78 in plate 41.

Compressed air is delivered to chamber 43 of the motor from inlet 21 through a manually actuable valve 83 contained within a block 84 attached to body 22, and flows from the valve through passage 70 in side wall 36 into chamber 43. Air discharges from the chamber through a circularly elongated passage 85 formed in wall 36, and from that passage flows through passages 86 in parts 22 and 84 to a vertical tube 87 in block 84, which tube delivers the exhaust downwardly into an exhaust tube 88 connecting with a discharge hose 89.

Beneath the level of lower bearing 40, carrier part 14 has an enlarged portion 89 which is typically externally cylindrical about axis 15, and which contains a recess 90 centered about the second axis 17 which is parallel to but offset laterally from axis 15. The orbitally driven part 16 has an upper reduced diameter portion 91 which projects upwardly into recess 90 and is centered about axis 17 and is journaled by two bearings 92 and 93 for rotation about axis 17 relative to carrier 14, so that as the carrier turns the part 16 is given an orbital motion. A lower enlarged diameter flange portion 94 of part 16 has an annular horizontal undersurface 95 disposed transversely of axis 17. A threaded bore 96 extends upwardly into part 16 and is centered about vertical axis 17, for engagement with an externally threaded screw 97 which detachably secures head 18 to the rest of the device. A counterweight plate 98 may be located vertically between carrier 14 and flange 94 of part 16, and be secured rigidly to part 14 by appropriate fasteners, and may be externally non-circular about axis 15 to counterbalance the eccentrically mounted part 16, head 18, and other connected elements.

Head 18 may be rectangular in horizontal section, including an upper horizontally rectangular rigid flat metal backing plate 99 having a rectangular resiliently deformable cushion 100 at its underside typically formed of foam rubber or the like. The rectangular sheet of sandpaper 19 extends along the undersurface of cushion 100, and then extends upwardly at opposite ends of the head for retention of its ends by two clips 101. Screw 97 extends upwardly through an opening in plate 99 to secure head 19 to the orbitally moving part 16.

The lower end 102 of the flexible tubular boot 33 carries and is permanently attached to a plate 103 preferably formed of sheet metal which is essentially rigid. Plate 103 has a horizontal circular portion 104 extending parallel to the upper surface of plate 99, and at its periphery has an upwardly turned cylindrical side wall portion 105 fitting closely about and bonded annularly to the lower externally cylindrical portion 102 of rubber boot 33. Plate 103 has a central opening 106 through which screw 96 extends upwardly, so that upon tightening of the screw plate 103 is rigidly clamped between plate 99 and element 16, with boot 33 then functioning to retain head 18 against rotation relative to the upper portion of the tool.

In operating the tool, a user holds the tool by grasping the upper handle portion 26, and then pressing downwardly on a lever 107 to open valve 83 and admit compressed air to the motor chamber. The air drives rotor 42 rotatively, with that rotation being transmitted to the upper reduced diameter shaft portion 44 of carrier 14. The rotation of the lower enlarged portion of carrier 14 causes orbital movement of head 18 and its carried sandpaper sheet 19, to abrade the work surface 12.

The provision of the metal plate 41 at the under side of the rotor serves the dual purposes of preventing wear of rotor 42, vanes 67 and bottom wall 39 of the motor housing, and also preventing downward flow of air from the motor chamber along the exterior of shaft 44 and through bearing 40. As previously discussed, this prevents inefficiencies which may result from loss of air pressure, and protects bearing 40 against contamination by dust particles or other materials carried in the air and against loss of grease or other lubricant by the flow of air.

Bearing 40 may be of a type which would allow a substantial flow of air downwardly through the bearing and through bottom wall 39 in the absence of the restriction offered at gap 79. The bearing preferably has annular dust shields 108, but these shields may leave annular gaps 109 several thousandths of an inch wide (typically three to five thousandths), through which air could flow if it were not blocked off at 79. Similarly, annular gaps 110 and 111 past the inner and outer races of the bearing may be several thousandths of an inch wide (typically five to seven thousandths). Also, there are of course the usual relatively open spaces circularly between and about the balls 112 of the bearing and past the ball retainer 113. There may thus be an air flow path downwardly entirely through wall 39 and its contained bearing 40 which is at all points substantially wider and less restricted than the gap 79. Preferably, all of the gaps 179, 109, 110 and 111, and the other spaces about the balls and retainer forming the air flow path, are at all points along that path at least several thousandths of an inch wide, and at least several times as wide as gap 79. The various discussed gaps and spaces defining the air flow path within wall 39 and bearing 40 may initially be filled with grease or other lubricant, but in the absence of the restriction offered at gap 79 the lubricant would soon be blown downwardly out of the bearing. That restriction is therefore extremely important in protecting the bearing and maintaining it in properly lubricated condition.

While a certain specific embodiment of the present invention has been disclosed as typical, the invention is of course not limited to this particular form, but rather is applicable broadly to all such variations as fall within the scope of the appended claims.

I claim:

1. A portable abrading or polishing tool comprising:

a body structure adapted to be held by a user to manipulate the tool;

an air motor carried by said body structure;

a head movable relative to said body structure by said air motor and adapted to carry an element for abrading or polishing a work surface;

said motor including a housing containing a chamber having a top wall, a bottom wall and a side wall; a rotor in said chamber adapted to be driven by air rotatively about an essentially vertical axis and having an undersurface facing downwardly toward said bottom wall of the chamber; an essentially vertical shaft driven by said rotor and projecting downwardly through said bottom wall of the housing and connected operatively to said head to drive it; and upper and lower bearings carried by said top and bottom walls respectively and journalled said shaft for rotation about said axis;

said motor including a generally horizontal wear plate within said chamber at a location above said bottom wall and beneath said rotor and in contact with said undersurface of the rotor, and which is of a material harder than said rotor and harder than said bottom wall of the housing;

said plate containing a circular opening defined by a circular inner edge of the plate centered about said axis and about a cylindrical external surface of said shaft at a level above said bottom wall and above said lower bearing;

said circular inner edge of the plate which defines said opening having an internal diameter which exceeds the diameter of said cylindrical external surface of the shaft contained therein, but only very slightly, by an amount between one ten thousandth (0.0001) of an inch and six ten thousandths (0.0006) of an inch, to substantially block off all flow of air downwardly from said chamber and to said lower bearing, while maintaining a minute gap between said edge and said cylindrical surface avoiding frictional damage thereto and resistance to rotation of the shaft.

2. A portable abrading or polishing tool as recited in claim 1, in which said plate is formed of spring steel.

3. A portable abrading or polishing tool as recited in claim 1, in which said rotor and said top, bottom and side walls of said housing are formed of powdered metal.

4. A portable abrading or polishing tool as recited in claim 1, in which said plate has a Rockwell hardness of at least about 45 on the C scale.

5. A portable abrading or polishing tool as recited in claim 1, in which said rotor and said top, bottom and side walls of said housing are formed of powdered metal, and said plate is formed of spring steel having a Rockwell hardness of at least about 45 on the C scale.

6. A portable abrading or polishing tool comprising:

a body structure adapted to be held by a user to manipulate the tool:

an air motor carried by said body structure;

a head movable relative to said body structure by said air motor and adapted to carry an element for abrading or polishing a work surface;

said motor including a housing containing a chamber having a top wall, a bottom wall and a side wall; a rotor in said chamber adapted to be driven by air rotatively about an essentially vertical axis and having an undersurface facing downwardly toward said bottom wall of the chamber; an essentially vertical shaft driven by said rotor and projecting downwardly through said bottom wall of the housing and connected operatively to said head to drive it; and upper and lower bearings carried by said top and bottom walls respectively and journalled said shaft for rotation about said axis;

said motor including a generally horizontal wear plate within said chamber at a location above said bottom wall and beneath said rotor and in contact with said undersurface of the rotor, and which is of a material harder than said rotor and harder than said bottom wall of the housing;

said plate containing a circular opening defined by a circular inner edge of the plate centered about said axis and about a cylindrical external surface of said shaft at a level above said bottom wall and above said lower bearing;

said circular inner edge of the plate which defines said opening having an internal diameter which exceeds the diameter of said cylindrical external surface of the shaft contained therein, but only very slightly, by an amount between one ten thousandth (0.0001) of an inch and six ten thousandths (0.0006) of an inch, to substantially block off all flow of air downwardly from said chamber and to said lower bearing, while maintaining a minute gap between said edge and said cylindrical surface avoiding frictional damage thereto and resistance to rotation of the shaft;

said lower bearing being contained within a recess in the underside of said bottom wall of the housing and including an outer race and an inner race and a series of rotating bearing elements therebetween;

said bottom wall having an upper annular portion which projects radially inwardly at the upper side of said lower bearing to a location beyond said outer race and vertically above said inner race, and which contains an opening defined by an inner edge of said upper portion of the bottom wall near but spaced from said shaft and above said inner race;

said inner edge of said plate being at a diameter less than the diameter of said inner edge of said upper portion of said bottom wall of the housing.

7. A portable abrading or polishing tool as recited in claim 1, in which said body includes a part having an essentially tubular side wall containing an internal cylindrical surface; said top wall and said bottom wall and said side wall of the motor housing all being externally circular and of approximately the same diameter and contained closely within said internal cylindrical surface of said part; said plate being externally circular and of substantially the same diameter as said top wall, bottom wall and side wall, and being received within said internal cylindrical surface which contains said top wall, bottom wall and side wall; there being means retaining said top wall and said bottom wall and said side wall and said plate within said cylindrical surface, and clamping the periphery of said plate axially between said bottom wall and said side wall.

8. A portable abrading or polishing tool as recited in claim 7, in which said rotor and said top, bottom and side walls of said housing are formed of powdered metal, and said plate is formed of spring steel having a Rockwell hardness of at least about 45 on the C scale.

9. A portable abrading or polishing tool comprising:

a body structure adapted to be held by a user to manipulate the tool:

an air motor carried by said body structure;

a head movable relative to said body structure by said air motor and adapted to carry an element for abrading or polishing a work surface;

said motor including a housing containing a chamber having a top wall, a bottom wall and a side wall; a rotor in said chamber adapted to be driven by air rotatively about an essentially vertical axis and having an undersurface facing downwardly toward said bottom wall of the chamber; an essentially vertical shaft driven by said rotor and projecting downwardly through said bottom wall of the housing and connected operatively to said head to drive it; and upper and lower bearings carried by said top and bottom walls respectively and journalled said shaft for rotation about said axis;

said motor including a generally horizontal wear plate within said chamber at a location above said bottom wall and beneath said rotor and in contact with said undersurface of the rotor, and which is of a material harder than said rotor and harder than said bottom wall of the housing;

said plate containing a circular opening defined by a circular inner edge of the plate centered about said axis and about a cylindrical external surface of said shaft at a level above said bottom wall and above said lower bearing;

said circular inner edge of the plate which defines said opening having an internal diameter which exceeds the diameter of said cylindrical external surface of the shaft contained therein, but only very slightly, by an amount between one ten thousandth (0.0001) of an inch and six ten thousandths (0.0006) of an inch to substantially block off all flow of air downwardly from said chamber and to said lower bearing, while maintaining a minute gap between said edge and said cylindrical surface avoiding frictional damage thereto and resistance to rotation of the shaft;

said body including a part having an essentially tubular side wall containing an internal cylindrical surface;

said top wall and said bottom wall and said side wall of the motor all being externally circular and of approximately the same diameter and contained closely within said internal cylindrical surface of said part;

said plate being externally circular and of substantially the same diameter as said stop wall, bottom wall and side wall, and being received within said internal cylindrical surface which contains said top wall, bottom wall and side wall;

there being means retaining said top wall and said bottom wall and said side wall and said plate within said cylindrical surface, and clamping the periphery of said plate axially between said bottom wall and said side wall.

* * * * *